US012590550B2

(12) United States Patent
Tan

(10) Patent No.: US 12,590,550 B2
(45) Date of Patent: Mar. 31, 2026

(54) APPARATUS FOR ENERGY CONVERSION

(71) Applicant: G-EN PTE LTD, Singapore (SG)

(72) Inventor: Lien Chiow Tan, Singapore (SG)

(73) Assignee: G-EN PTE LTD, Singapore (SG)

( * ) Notice: Subject to any disclaimer, the term of this patent is extended or adjusted under 35 U.S.C. 154(b) by 0 days.

(21) Appl. No.: 18/842,336

(22) PCT Filed: Jan. 26, 2024

(86) PCT No.: PCT/SG2024/050052
§ 371 (c)(1),
(2) Date: Aug. 28, 2024

(87) PCT Pub. No.: WO2024/162899
PCT Pub. Date: Aug. 8, 2024

(65) Prior Publication Data

US 2025/0188854 A1 Jun. 12, 2025

(30) Foreign Application Priority Data

Jan. 30, 2023 (CN) ..... 202320085929.3
Jan. 10, 2024 (SG) ..... 10202400082Y

(51) Int. Cl.
*F01K 25/10* (2006.01)
*F01C 1/344* (2006.01)
(Continued)

(52) U.S. Cl.
CPC ..... *F01K 25/103* (2013.01); *F01C 1/3441* (2013.01); *F01C 13/00* (2013.01); *F01C 21/06* (2013.01); *F01K 27/00* (2013.01)

(58) Field of Classification Search
CPC ..... F01K 25/103; F01K 27/00; F01C 1/3441; F01C 13/00; F01C 21/06; F03G 4/00;
(Continued)

(56) References Cited

U.S. PATENT DOCUMENTS 4,438,881 A * 3/1984 Pendergrass ..... F24D 11/0221 62/235.1
5,533,566 A * 7/1996 Fineblum ..... F28D 19/04 165/47
(Continued)

FOREIGN PATENT DOCUMENTS

WO WO2016186572 A1 11/2016
WO WO2016186579 A1 11/2016
(Continued)

*Primary Examiner* — Hoang M Nguyen
(74) *Attorney, Agent, or Firm* — MUNCY, GEISSLER, OLDS & LOWE, P.C.

(57) ABSTRACT

An apparatus and a method of for energy conversion to dual-functionality are disclosed. The apparatus includes a storage container configured to store a working medium fluid and a pressure release valve configured to release the working medium fluid. A vane motor receives the working medium fluid at a high pressure. An embedded heat exchanger is encased within the vane motor that creates an interface between the working medium fluid within the vane motor and an energy carrier fluid, for heat exchange to occur therebetween. Upon the heat exchange, the temperature and pressure of the working medium fluid increases and the temperature of the energy carrier fluid decreases. The vane motor within an electric generator act as rotor, is rotated under combined effect of the working medium fluid entering the vane motor at high pressure and the pressure of the working medium fluid increasing upon heat exchange.

40 Claims, 5 Drawing Sheets

(51) Int. Cl.
*F01C 13/00* (2006.01)
*F01C 21/06* (2006.01)
*F01K 27/00* (2006.01)

(58) Field of Classification Search
CPC . F03G 7/04; F03G 7/003; F03G 6/092; F03G 7/0646; F25B 13/00; F25B 41/20; F25B 9/008; F25B 9/14; F28D 21/00; F28D 2021/0019
See application file for complete search history.

(56) References Cited

U.S. PATENT DOCUMENTS

| | | | | |
|---|---|---|---|---|
| 8,297,252 | B1 * | 10/2012 | Landin | F02B 53/04 418/246 |
| 8,839,620 | B2 * | 9/2014 | Teng | F01K 23/065 60/598 |
| 10,113,427 | B1 * | 10/2018 | Davis | F01C 1/3441 |
| 2003/0136126 | A1 | 7/2003 | Dearman | |
| 2010/0050628 | A1 | 3/2010 | Staffend et al. | |
| 2014/0202152 | A1 | 7/2014 | Lew | |

FOREIGN PATENT DOCUMENTS

| | | | |
|---|---|---|---|
| WO | WO2020040698 | A1 | 2/2020 |
| WO | WO2022225486 | A2 | 10/2022 |

* cited by examiner

APPARATUS FOR ENERGY CONVERSION

CROSS REFERENCE TO RELATED APPLICATIONS

The present application claims the filing date of an earlier Chinese Utility Model application Nr. 202320085929.3 as its priority, which was filed on 30 Jan. 2023. The present application further claims the filing date of an earlier Singapore patent application Nr. 10202400082Y, which was filed on 10 Jan. 2024. All contents or relevant information is hereby incorporated by reference, wherever relevant or appropriate.

FIELD OF THE INVENTION

The present disclosure relates to energy conversion, and more particularly, to a low-grade heat powered apparatus having dual-functionality of a generator and a chiller, and methods of operations thereof.

BACKGROUND OF THE INVENTION

Electricity is an essential requirement of present civilisation. However, electricity is generally generated from mechanical power which is mostly obtained by burning of fossil fuels for conversion to mechanical power. The use of fossil fuels is not sustainable as it non-renewable, contributes to environmental pollution, and emits greenhouse gases which triggers climate change. Various efforts have been made to generate electricity using renewable sources, such as sunlight and wind using photovoltaic and wind turbine technologies, respectively. However, these solutions may not be available at all the locations and all the time for effective harvesting.

Therefore, an effective solution for electricity generation is desired that is available in abundance and overcomes the challenges otherwise posed by the use of fossil fuels.

SUMMARY OF THE INVENTION

This summary is provided to introduce a selection of concepts, in a simplified format, that are further described in the detailed description of the invention. This summary is neither intended to identify key or essential inventive concepts of the invention and nor is it intended for determining the scope of the invention.

In an implementation of the present disclosure, an apparatus for energy conversion optionally with dual-functionalities of a generator and a chiller is disclosed. The apparatus may include a storage container configured to store a working medium fluid, wherein the working medium fluid is stored in the storage container at a first temperature and a first pressure and a pressure release valve coupled with the storage container. The pressure release valve may be configured to release the working medium fluid to a second pressure. The temperature of the working medium fluid drops to a second temperature as a result of release. In some embodiments, the second temperature of the working medium fluid is less than or equal to −40° C. The second pressure is lower than the first pressure, and the second temperature is lower than the first temperature of the working medium fluid. The apparatus further includes a vane motor configured to receive the working medium fluid at a third pressure, the third pressure being greater than the second pressure. The apparatus further includes an embedded heat exchanger encased within the vane motor configured to create an interface between the working medium fluid within the vane motor and an energy carrier fluid, for heat exchange to occur between the working medium fluid and the energy carrier fluid. Upon the heat exchange, the temperature and pressure of the working medium fluid increases and the temperature of the energy carrier fluid decreases. Upon the heat exchange, the temperature of the energy carrier fluid decreases to a third temperature, such that the third temperature may be close to 1° C. Further, upon the heat exchange, the temperature of the working medium fluid may increase to a fourth temperature, such that the fourth temperature is within a temperature range of 20° C. to 32° C.

The embedded heat exchanger contained in a ring module configured to be removably encased within the vane motor. The vane motor may be rotated under combined effect of the working medium fluid entering the vane motor at the third pressure and the pressure of the working medium fluid increasing upon the heat exchange.

The apparatus may further include a pressure regulator fluidically coupled with the pressure release valve. The pressure regulator may be configured to regulate the pressure drop to the second pressure. When the pressure release valve is opened, a high-pressure working medium fluid may discharge into the pressure regulator, to the second pressure.

The apparatus may further include a high-pressure pump positioned between the pressure release valve and the vane motor. The high-pressure pump may be configured to receive the cold working medium fluid from the pressure release valve and pump the cold working medium fluid into the vane motor at the third pressure. The high-pressure pump may be configured to receive the cold working medium fluid from the pressure release valve and pump the working medium fluid into the vane motor at the third pressure.

The apparatus may further include an electricity generator mechanically coupled within the vane motor and configured to generate electric power using the rotation of the vane motor. The electricity generator may be mechanically coupled within the vane motor, via a plurality of vanes of the vane motor configured to engage with a plurality of slots on an outer side of the electricity generator. The electricity generator encased within the vane motor acts as the rotor, to provide a compact assembly of the electricity generator and the vane motor.

In some embodiments, the working medium fluid may be Carbon Dioxide (CO2). CO2 becomes very cold because of its thermodynamic property. As such, once the working medium fluid (CO2) is released via the pressure release valve, the temperature of the working medium fluid falls to the second temperature which is lower than the first temperature.

In some embodiments, the energy carrier fluid may be water.

The embedded heat exchanger contained in the ring module may include a peripheral enclosure along a periphery of the ring module defining: a closed space and an inner wall. The peripheral enclosure may be configured to receive the energy carrier fluid in the closed space. Further, the inner wall may act as an inner surface of the vane motor whilst creating the interface between the working medium fluid within the vane motor and the energy carrier fluid within the closed space. The embedded heat exchanger contained in the ring module may further include an inlet orifice configured to allow passage of the working medium fluid into the vane motor, across the peripheral enclosure and an outlet orifice configured to allow passage of the working medium fluid out of the vane motor, across the peripheral enclosure. The embedded heat exchanger contained in the ring module may further include at least one inlet port configured to allow passage of the energy carrier fluid into the peripheral enclosure and at least one outlet port configured to allow passage of the energy carrier fluid out of the peripheral enclosure. The embedded heat exchanger, contained in the ring module, may be removably encased within the vane motor. In particular, the ring module may constitute an inner surface of the vane motor. As such, the ring module may sit between an inner wall of a housing of the vane motor and the encased electricity generator. The embedded heat exchanger contained in the ring module may be encased in the vane motor at a section where the working medium fluid enters the vane motor.

In some embodiments, the at least one inlet port may include a first inlet port positioned in proximity to the inlet orifice and a second inlet port positioned in proximity to the outlet orifice. The energy carrier fluid flow entering the embedded heat exchanger via the first inlet port may be controlled, such that the working medium fluid is at ambient room temperature, i.e. about 20° C. or higher when the working medium fluid exits the vane motor. Furthermore, the temperature and the pressure of the working medium fluid may continue to increase as it gets in contact with the energy carrier fluid streaming in via the second inlet port within the vane motor.

The at least one outlet port may include a first outlet port positioned substantially mid-way of the first inlet port and the second inlet port and a second outlet port positioned substantially mid-way of the first inlet port and the second inlet port. The energy carrier fluid, upon entering into the embedded heat exchanger via each of the first inlet port and the second inlet port, may move towards each other and exit midway via the first outlet port and the second outlet port.

In some embodiments, a heat exchange area may be defined on a portion of the peripheral enclosure, such that the heat exchange occurs along the heat exchange area.

In some embodiments, each pair of vanes of the plurality of vanes of the vane motor along with the inner wall may define a vane chamber therebetween. A volume of the vane chamber defined throughout along the heat exchange area may be the same.

The apparatus may further include at least one flow-regulating valve fluidically coupled with the at least one outlet port. The flow-regulating valve may be configured to regulate the flow of the energy carrier fluid from the embedded heat exchanger, such that the temperature of the energy carrier fluid may drop to around 1° C. (as chilled water).

The working medium fluid, upon exiting from the vane motor, may be directed into the storage container. At the time of entering the storage container, the pressure of the working medium fluid may be lower than the first pressure.

The apparatus may further include a chiller heat exchanger configured to receive the energy carrier fluid from the embedded heat exchanger, via a secondary pump. The chiller heat exchanger may be further configured to raise the temperature of the energy carrier fluid up from the third temperature. The apparatus, which can therefore be a combination of the electricity generator and a chiller, may provide for a compact and portable solution which is also scalable to power residential/commercial buildings of any size, ships, motor vehicles, trains, and airplanes. Further, the apparatus may provide for energy saving in air-conditioning by the use of the chilled energy carrier fluid.

The apparatus may further include a first check valve positioned between the high-pressure pump and the vane motor, to prevent a backflow of the working medium fluid therebetween. The apparatus may further include a second check valve positioned between the vane motor and the storage container, to prevent a backflow of the working medium fluid therebetween. The apparatus may further include a third check valve positioned between the vane motor and the chiller heat exchanger, to prevent a backflow of the energy carrier fluid therebetween.

In another implementation of the present disclosure, a method of energy conversion is disclosed. The method may include releasing a working medium fluid stored in a storage container via a pressure release valve coupled with the storage container. The working medium fluid may be stored in the storage container at a first temperature and a first pressure. The pressure release valve may be configured to release the working medium fluid to a second pressure. The temperature of the working medium fluid may drop to a second temperature as a result of release. The second pressure may be less than the first pressure, and the second temperature may be less than the first temperature of the working medium fluid. The method may further include inputting the working medium fluid to a vane motor at a third pressure, the third pressure being greater than the second pressure. The method may further include interfacing the working medium fluid within the vane motor with an energy carrier fluid, via an embedded heat exchanger encased within the vane motor, for heat exchange to occur between the working medium fluid and the energy carrier fluid. Upon the heat exchange, the temperature and pressure of the working medium fluid increases and the temperature of the energy carrier fluid decreases. The embedded heat exchanger contained in a ring module configured to be removably encased within the vane motor. The vane motor may be rotated under combined effect of the working medium fluid entering the vane motor at the third pressure and the pressure of the working medium fluid increasing upon the heat exchange. The vane motor may be rotated under combined effect of the working medium fluid entering the vane motor at the third pressure and the pressure of the working medium fluid increasing upon the heat exchange, to drive an electricity generator mechanically coupled within the vane motor to generate electric power. The method may further include receiving the energy carrier fluid in a chiller heat exchanger from the embedded heat exchanger. The chiller heat exchanger may be configured to raise the temperature of the energy carrier fluid up from the third temperature.

BRIEF DESCRIPTION OF THE DRAWINGS

To further clarify the advantages and features of the present invention, a more particular description of the invention will be rendered by reference to specific implementations thereof, which is illustrated in the appended drawings. It is appreciated that these drawings depict only typical implementations of the invention and are therefore not to be considered limiting of its scope. The invention will be described and explained with additional specificity and detail with the accompanying drawings.

These and other features, aspects, and advantages of the present invention will become better understood when the following detailed description is read with reference to the accompanying drawings in which like characters represent like parts throughout the drawings, wherein.

DETAILED DESCRIPTION

Figure 1:
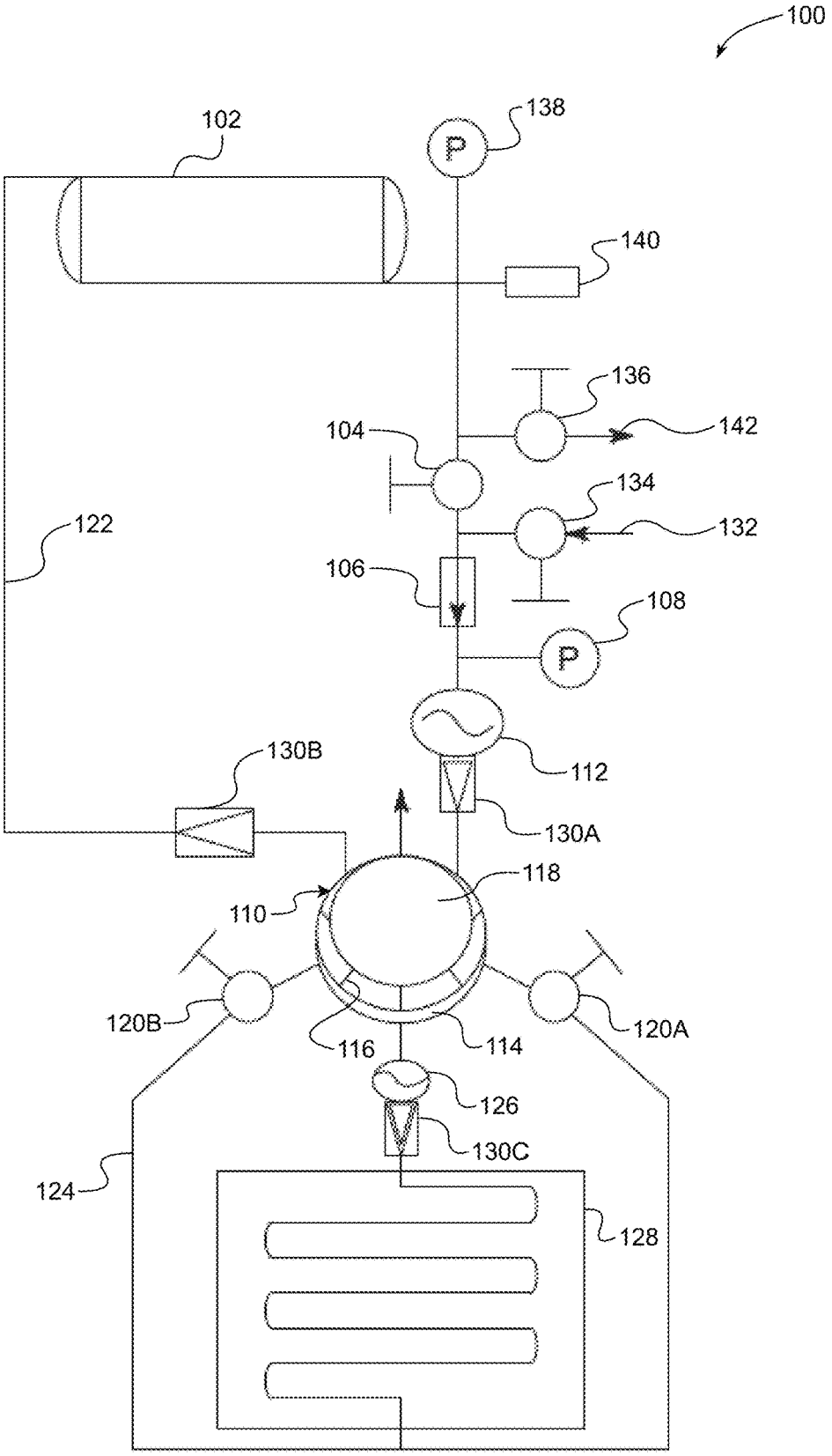
FIG. 1 illustrates a block diagram depicting an apparatus for energy conversion, according to an implementation of the present disclosure.

Further, skilled artisans will appreciate that elements in the drawings are illustrated for simplicity and may not have necessarily been drawn to scale. For example, the flow charts illustrate the method in terms of the most prominent steps involved to help to improve understanding of aspects of the present invention. Furthermore, in terms of the construction of the device, one or more components of the device may have been represented in the drawings by conventional symbols, and the drawings may show only those specific details that are pertinent to understanding the implementations of the present invention so as not to obscure the drawings with details that will be readily apparent to those of ordinary skill in the art having benefit of the description herein.

For the purpose of promoting an understanding of the principles of the invention, reference will now be made to the implementation illustrated in the drawings and specific language will be used to describe the same. It will nevertheless be understood that no limitation of the scope of the invention is thereby intended, such alterations and further modifications in the illustrated apparatus, and such further applications of the principles of the invention as illustrated therein being contemplated as would normally occur to one skilled in the art to which the invention relates. Unless otherwise defined, all technical and scientific terms used herein have the same meaning as commonly understood by one of ordinary skilled in the art to which this invention belongs. The apparatus, methods, and examples provided herein are illustrative only and not intended to be limiting.

Whether or not a certain feature or element was limited to being used only once, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language including, but not limited to, "there needs to be one or more . . . " or "one or more element is required."

Unless otherwise defined, all terms and especially any technical and/or scientific terms, used herein may be taken to have the same meaning as commonly understood by a person ordinarily skilled in the art.

Reference is made herein to some "implementations." It should be understood that an implementation is an example of a possible implementation of any features and/or elements of the present disclosure. Some implementations have been described for the purpose of explaining one or more of the potential ways in which the specific features and/or elements of the proposed disclosure fulfil the requirements of uniqueness, utility, and non-obviousness.

Use of the phrases and/or terms including, but not limited to, "a first implementation," "a further implementation," "an alternate implementation," "one implementation," "an implementation," "multiple implementations," "some implementations," "other implementations," "further implementation", "furthermore implementation", "additional implementation" or other variants thereof do not necessarily refer to the same implementations. Unless otherwise specified, one or more particular features and/or elements described in connection with one or more implementations may be found in one implementation, or may be found in more than one implementation, or may be found in all implementations, or may be found in no implementations. Although one or more features and/or elements may be described herein in the context of only a single implementation, or in the context of more than one implementation, or in the context of all implementations, the features and/or elements may instead be provided separately or in any appropriate combination or not at all. Conversely, any features and/or elements described in the context of separate implementations may alternatively be realized as existing together in the context of a single implementation.

Any particular and all details set forth herein are used in the context of some implementations and therefore should not necessarily be taken as limiting factors to the proposed disclosure.

Implementations of the present invention will now be described below in detail with reference to the accompanying drawings.

The present disclosure provides for utilizing a renewable energy source of energy in form of low-grade heat of 20 degrees Celsius (° C.) and above. This low-grade heat is abundantly available in the ambient atmosphere or as waste heat from industrial operations. Further, in absence of this low-grade heat, burning of renewable non-pollutive fuels like magnesium or hydrogen can be used as well. This low-grade heat requires an apparatus for energy conversion that can convert the low-grade heat into useful mechanical motion, that can be used to further drive a generator to generate electricity.

To this end, a cold hydraulic powered generator with combined delivery function of a chiller is disclosed, in which a cold working medium fluid (for example, Carbon Dioxide ($CO_2$)) at a temperature of about −40° C. or lower is generated in situ. The working medium fluid operates in a closed loop cycle. An energy carrier fluid (for example, water) harvests ambient heat or waste heat from machine or industrial operations and is pumped into an embedded heat exchanger encased in a vane motor. Further, an electricity generator may also be encased within the vane motor. The cold working medium fluid is pumped into the vane motor. The cold working medium fluid flows by and absorbs energy from the warm energy carrier fluid in the heat exchanger without mixing together. The cold working medium fluid becomes warmer and its pressure increases. This increase in the pressure is used to drive the electricity generator to generate electricity. The warm energy carrier fluid becomes chilled by the time it exists the vane motor. As a result, an electricity output and a chilled fluid are obtained. The chilled energy carrier may collect more heat to reach temperature of 20° C. and above, before it returns back to power the generator. The apparatus, therefore, provides dual function of the electricity generator and the chiller combined.

The electricity generated is clean and renewable as it does away with the requirement of burning of fossil fuels. The heat source is ambient heat, or waste heat from industrial operations, or natural heat from deep in the earth or other sources like heat pump, or even heat from burning of renewable resources like magnesium, hydrogen or thermite. The chilled energy carrier fluid can be used for air-conditioning (where the energy carrier fluid is warmed).

The above apparatus which is combination of an electricity generator and a chiller provides for a compact and portable solution. This apparatus provides a scalable solution to power residential/commercial buildings of any size, ships, motor vehicles, trains, and airplanes. Further, the above apparatus provides for energy saving in air-conditioning by the use of the chilled energy carrier fluid. Moreover, the above apparatus provides a solution for decarbonization, mitigating climate change, and providing low-cost clean energy security and independence for all societies.

FIG. 1 illustrates a schematic diagram depicting an apparatus for energy conversion 100, according to an implementation of the present disclosure. In an implementation of the present disclosure, the apparatus for energy conversion 100 may include a storage container 102 configured to store a working medium fluid. The working medium fluid may be stored in the storage container 102 at a first temperature and a first pressure. By way of an example, the working medium fluid may be Carbon Dioxide (CO2), and in particular, liquid CO2. It should be noted that the first temperature and the first pressure may be predefined. In some embodiments, the first temperature at which the working medium fluid (liquid CO2) may be stored in the storage container 102 may be room temperature, i.e. above 20 degrees Celsius (° C.). The first pressure at which the working medium fluid (liquid CO2) may be stored in the storage container 102 may be around 70 bars, when not in operation. The storage container, for example, may be a metal cylinder capable of storing a high-pressure fluid.

The apparatus for energy conversion 100 may further include a pressure release valve 104 coupled with the storage container 102. For example, the pressure release valve 104 may be a start/stop valve. The pressure release valve 104 may be configured to release the working medium fluid to a second pressure. As a result of release, the temperature of the working medium fluid drops to a lower temperature (a second temperature), and thereby the working medium fluid becoming a cold working medium fluid. The second pressure may be lower than the first pressure. Further, the second temperature may be lower than the first temperature of the working medium fluid. When the pressure release valve 104 is opened, the high-pressure liquid CO2 may discharge into a pressure regulator 106, to the second pressure. The second pressure may be about 10 bars, for example. A first pressure gauge 108 may be provided in proximity to the pressure regulator 106 to constantly monitor the pressure of the working medium fluid as it is released. As a result of being released to the lower pressure (i.e. the second pressure), the working medium fluid (liquid CO2) becomes very cold because of the thermodynamic property of the working medium fluid (CO2). As such, once the working medium fluid is released via the pressure release valve 104, the temperature of the working medium fluid falls to the second temperature which is lower than the first temperature.

Figure 4:
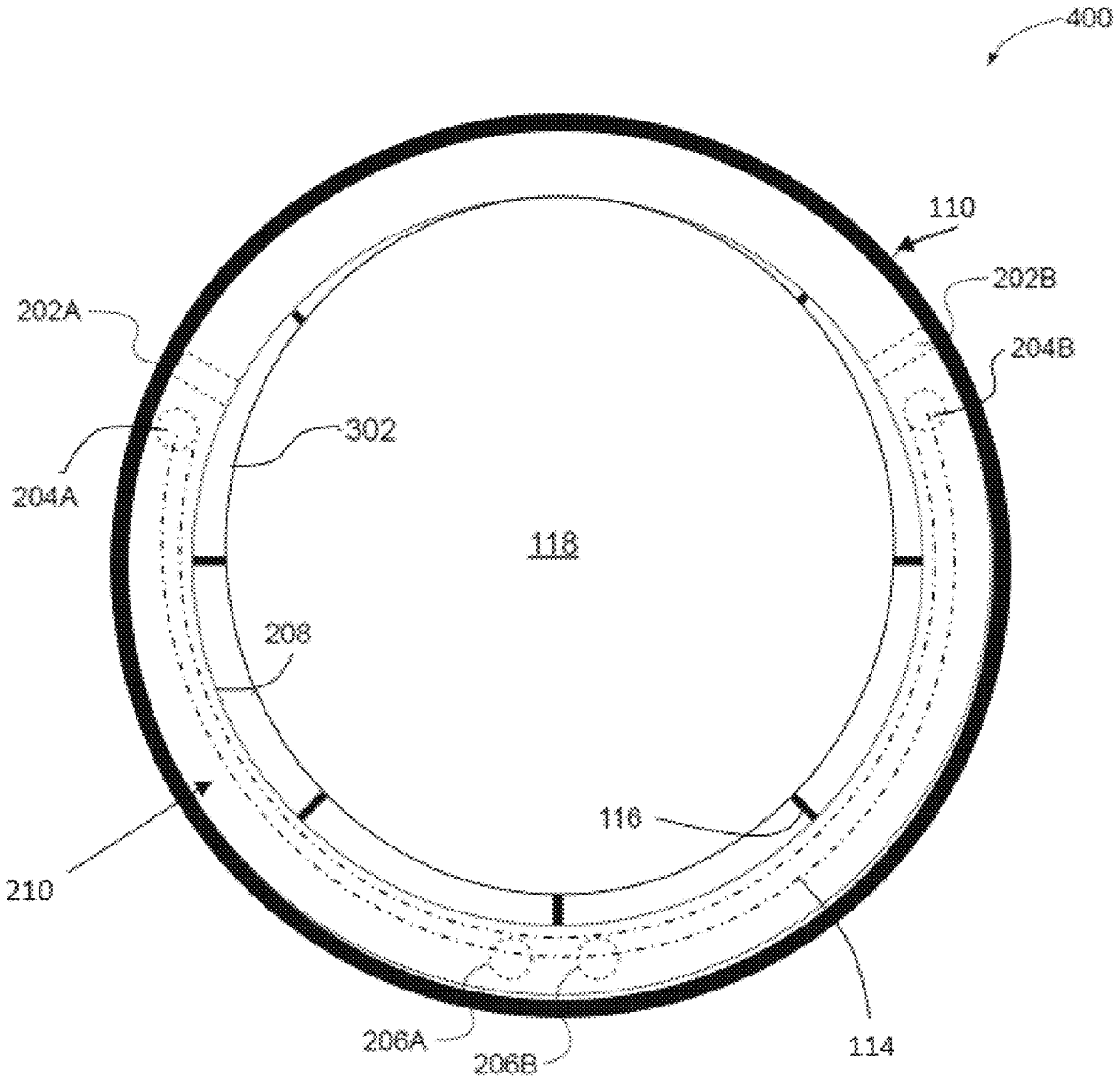
FIG. 4 illustrates a schematic front view of a vane motor of the apparatus of FIG. 1 along with the embedded heat generator and the electricity generator encased in the vane motor, in accordance with an implementation of the present disclosure.

The apparatus for energy conversion 100 may further include a vane motor 110 configured to receive the working medium fluid at a third pressure (also referred to as "introductory pressure" in this disclosure). The third pressure may be greater than the second pressure, i.e. greater than 10 bars. To this end, the apparatus for energy conversion 100 may include a high-pressure pump 112 which may be positioned between the pressure release valve 104 and the vane motor 110 (as shown in FIG. 4). The high-pressure pump may be configured to receive the cold working medium fluid from the pressure release valve 104 and pump the working medium fluid into the vane motor 110 at the third pressure. As shown in FIG. 1, the cold working medium fluid at an inlet of the high-pressure pump 112 may be pumped into the vane motor 110. A first check valve 130A may be positioned between the high-pressure pump 112 and the vane motor 110, to prevent a backflow of the working medium fluid.

The apparatus for energy conversion 100 may further include an embedded heat exchanger 114. In some embodiments, the embedded heat exchanger 114 may be encased within the vane motor 110 (as shown in FIG. 4). In some embodiments, the embedded heat exchanger 114 may be contained in a ring module 210—a ring-shaped structure configured to be removably encased within the vane motor 110. In particular, in some embodiments, the ring module 210 may constitute an inner surface of the vane motor 110. The embedded heat exchanger 114 may be contained in the ring module 210 which may be encased in the vane motor 110 at a section where the working medium fluid enters the vane motor 110. However, the working medium fluid does not enter the embedded heat exchanger 114 while entering the vane motor 110. The embedded heat exchanger 114 may be configured to carry an energy carrier fluid therewithin. By way of an example, the energy carrier fluid may be water that may be circulated through the embedded heat exchanger 114 at a temperature of about 20° C. or higher. The embedded heat exchanger 114 is further explained in detail, in conjunction with FIG. 2.

Figure 2:
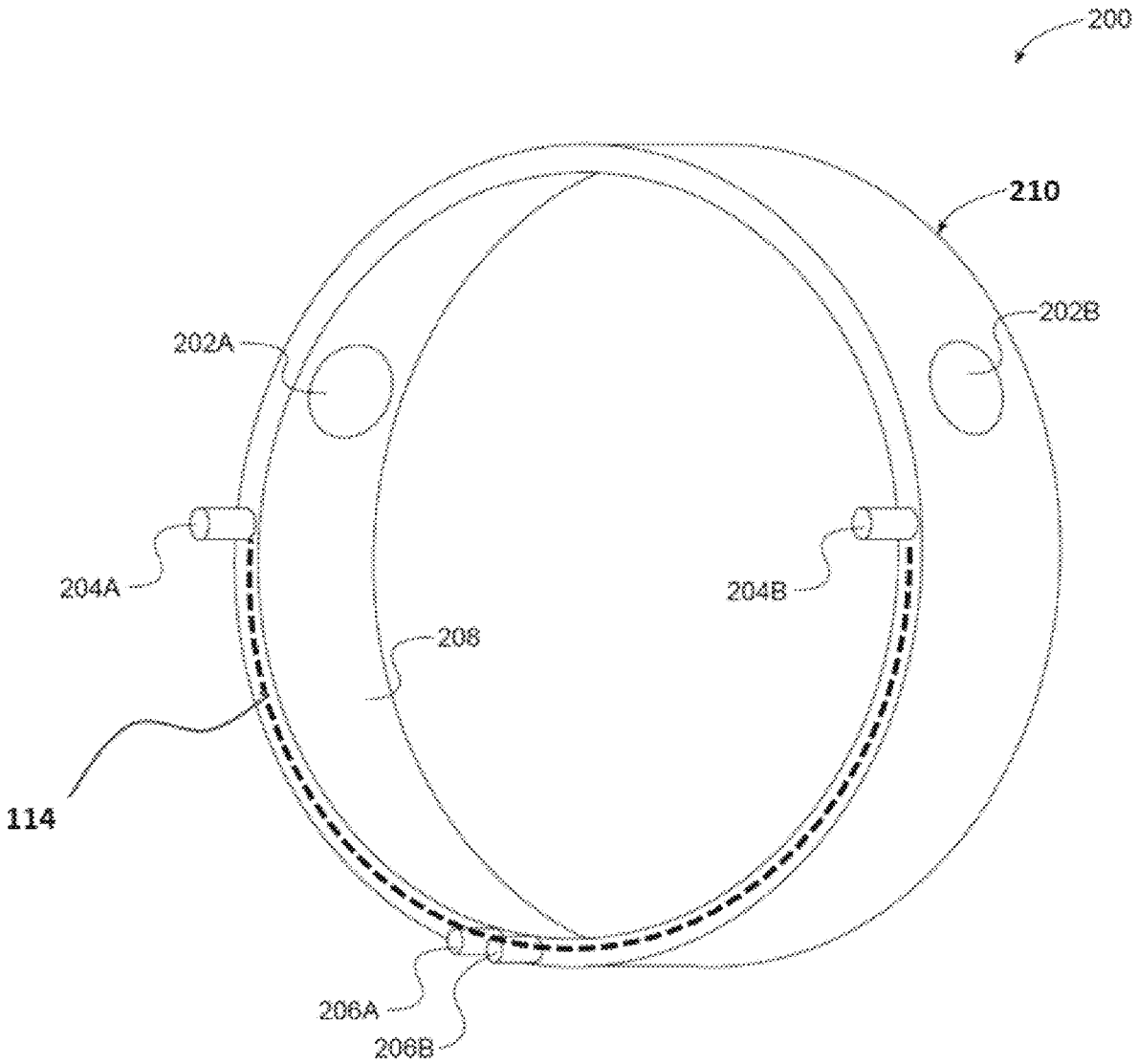
FIG. 2 illustrates a schematic perspective view of an embedded heat exchanger of the apparatus of FIG. 1, in accordance with an implementation of the present disclosure.

Referring now to FIG. 2, a schematic perspective view 200 of the embedded heat exchanger 114 is illustrated, in accordance with an implementation of the present disclosure. The embedded heat exchanger 114 is contained in the ring module 210, a ring-shaped structure (as shown in FIG. 4), configured to be removably encased within the vane motor 110. The embedded heat exchanger 114 may define a peripheral enclosure along a periphery of the ring module 210 defining a closed space. The peripheral enclosure may be configured to receive the energy carrier fluid in the closed space. The embedded heat exchanger 114 contained in the ring module 210 may further include an inner wall 208 acting as an inner surface of the vane motor 110. The inner wall 208 may create an interface between the working medium fluid within the vane motor 110 and the energy carrier fluid within the closed space of the embedded heat exchanger 114.

In some embodiments, as shown in FIG. 2 the ring module 210 where it contains the embedded heat exchanger 114, may include an inlet orifice 202A configured to allow passage of the working medium fluid into the vane motor 110, across the peripheral enclosure. The ring module 210 may further include an outlet orifice 202B configured to allow passage of the working medium fluid out of the vane motor 110, across the peripheral enclosure. As such, the working medium fluid may flow into vane motor 110 via the inlet orifice 202A and may flow out of the vane motor 110 via the outlet orifice 202B. The flow of working medium fluid between the inlet orifice 202A and outlet orifice 202B can be reversible.

The embedded heat exchanger 114 may include at least one inlet port configured to allow passage of the energy carrier fluid into the peripheral enclosure of the embedded heat exchanger 114. In particular, in some embodiments, as shown in FIG. 2, the embedded heat exchanger 114 may include two inlet ports—a first inlet port 204A positioned in proximity to the inlet orifice 202A and a second inlet port 204B positioned in proximity to the outlet orifice 202B. Further, the embedded heat exchanger 114 may include at least one outlet port configured to allow passage of the energy carrier fluid out of the peripheral enclosure. In particular, in some embodiments, as shown in FIG. 2, the embedded heat exchanger 114 may include two outlet ports—a first outlet port 206A positioned substantially mid-way of the first inlet port 204A and the second inlet port 204B, and a second outlet port 206B positioned substantially mid-way of the first inlet port 204A and the second inlet port 204B. As such, the energy carrier fluid may enter into the embedded heat exchanger 114 via each of the first inlet port 204A and the second inlet port 204B, and move towards each other and exit midway via the first outlet port 206A and the second outlet port 206B. In some embodiments, as shown in FIG. 2, at least one of the first inlet port 204A and the second inlet port 204B and at least one of the first outlet port 206A and the second outlet port 206B may be placed on the same flank side of the ring module 210.

The embedded heat exchanger 114 may be configured to create an interface between the working medium fluid within the vane motor 110 and the energy carrier fluid flowing through the peripheral enclosure along the periphery of the ring module 210, a ring-shaped structure of the embedded heat exchanger 114. In some embodiments, a heat exchange area may be defined on a portion of the peripheral enclosure of the ring module 210, a ring-shaped structure. The heat exchange occurs along the heat exchange area.

As a result of the interfacing, heat exchange occurs between the working medium fluid and the energy carrier fluid. Upon the heat exchange, the temperature and pressure of the working medium fluid may increase and the temperature of the energy carrier fluid may decrease. In example scenarios, the temperature of the energy carrier fluid may decrease to a third temperature. For example, the third temperature may be close to 1° C.

Referring back to FIG. 1, as mentioned above, the working medium fluid (very cold liquid CO2) may be pumped into the vane motor 110 using the high-pressure pump 112. The high pressure working medium fluid flowing into the vane motor 110 (via the inlet orifice 202A) may push a plurality of vanes 116 of the vane motor 110, to thereby move toward the outlet orifice 202B. As the working medium fluid (i.e. the very cold liquid CO2) flows and into the vane motor 110 and contacts the surface of the embedded heat exchanger 114, the energy carrier fluid (i.e. the warm water) heats up the working medium fluid, thereby raising the temperature of the working medium fluid. Further, the pressure of the working medium fluid also increases in the closed space formed between two adjacent vanes of the plurality of vanes 116. As a result, energy is transferred from the energy carrier fluid (warm water) to the working medium fluid (cold liquid CO2) to cause the vane motor 110 to rotate. The vane motor 110 may be rotated under combined effect of the working medium fluid entering the vane motor at the third pressure and the pressure of the working medium fluid increasing upon the heat exchange.

In some embodiments, the apparatus for energy conversion 100 may further include an electricity generator 118 which may be mechanically coupled with the vane motor 110. The electricity generator 118 may be configured to generate electric power using the rotation of the vane motor 110. To this end, the electricity generator 118 may be mechanically coupled with the vane motor 110, via the plurality of vanes 116 of the vane motor 110. This is further explained in conjunction with FIGS. 3-4.

Figure 3:
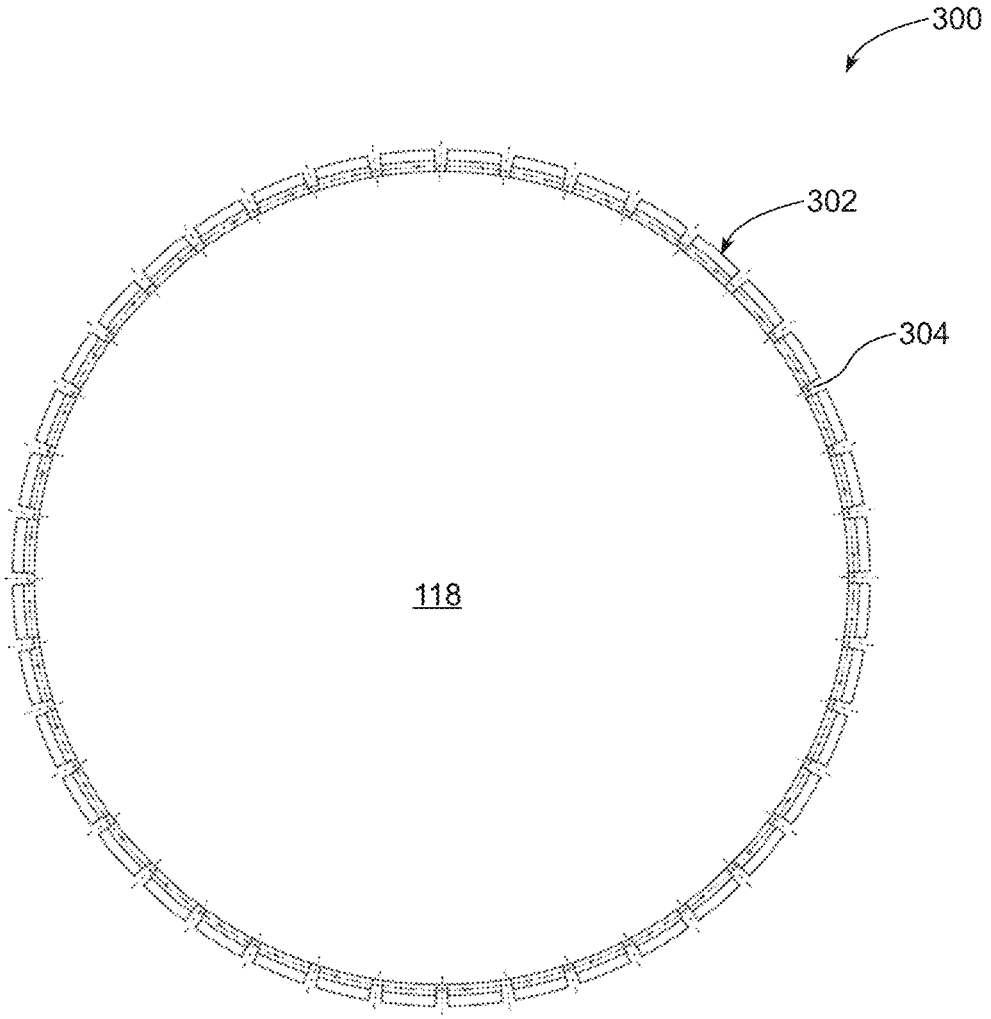
FIG. 3 illustrates a schematic front view of an electricity generator of the apparatus of FIG. 1, in accordance with an implementation of the present disclosure.

FIG. 3 illustrates a schematic front view 300 of the electricity generator 118, in accordance with an implementation of the present disclosure. FIG. 4 illustrates a schematic front view 400 of the vane motor 110 of the apparatus of FIG. 1 along with the embedded heat generator and the electricity generator encased in the vane motor, in accordance with an implementation of the present disclosure. As shown in FIG. 4, the embedded heat exchanger 114 and the electricity generator 118 are encased within the vane motor 110. As shown in FIG. 3, the electricity generator 118 may include an outer side 302, over which a plurality of slots 304 may be defined. Further, as shown in FIG. 4, the plurality of slots 304 defined on the outer side 302 may be configured to engage with the plurality of vanes 116 of the vane motor 110. The electricity generator 118, therefore, may be encased in the vane motor 110, where the rotation of the plurality of vanes 116 of the vane motor 110 may drive the electricity generator 118.

The vane motor 110 may include the embedded heat exchanger 114 (the terms embedded heat exchanger 114 and ring module 210, a ring-shaped structure may have been used interchangeably in this disclosure), which may include the peripheral enclosure along a periphery of the ring-shaped structure defining a closed space. The peripheral enclosure may be configured to receive the energy carrier fluid in the closed space. The ring module 210 may sit between an inner wall of a housing of the vane motor 110 and the encased electricity generator 118.

The inner wall 208 of the ring module 210 may be configured to define vane chambers of the vane motor 110 between the adjacent vanes to the plurality of vanes 116. In particular, each pair of vanes of the plurality of vanes 116 along with the inner wall may define a vane chamber therebetween. In some embodiments, a volume of the vane chamber defined throughout along the heat exchange area may be the same. In other words, the vane chambers may have the same volume throughout the section of the embedded heat exchanger 114. The volume of the vane chamber reduces (eventually to zero volume) by way of forcing the plurality of vanes 116 to retract to their respective slots at the same level of the inner wall of the (removable) ring module 210. The vane chamber space between the plurality of vanes 116 is created initially by gravity and subsequently by centrifugal force when the electricity generator 118 is rotating. The electricity generator 118 includes the plurality of slots 304 (defined on the outer side 302) for holding the plurality of vanes 116. With the plurality of vanes 116 sitting on the surface of the outer side 302 of the electricity generator 118, the electricity generator 118 acts as the rotating shaft of the vane motor 110. The electricity generated 118 may be further connected to an inverter (not shown in FIG. 4) for generating electricity at the required frequency and voltage.

Referring back to FIG. 1, it should be noted that the temperature of the working medium fluid at the time of entering the vane motor 110 may be less than or equal to −40° C. As a result of the interfacing between the working medium fluid and the energy carrier fluid, the temperature of the energy carrier fluid may drop, as it flows out of the embedded heat exchanger 114. The flow of the energy carrier fluid from the embedded heat exchanger 114 may be controlled by at least one flow-regulating valve fluidically coupled with the at least one outlet port. For example, as shown in FIG. 1, the apparatus for energy conversion 100 may include two flow-regulating valves 120A, 120B fluidically coupled with the first and second outlet ports 206A, 206B, respectively. The flow-regulating valves 120A, 120B may be configured to regulate the flow of the energy carrier fluid from the embedded heat exchanger 114. The flow-regulating valves 120A, 120B may regulate the flow of the energy carrier fluid from the embedded heat exchanger 114, such that the temperature of the energy carrier fluid is dropped to around 1° C. (as chilled water).

Further, as a result of the heat exchange, the temperature of the working medium fluid rises, but may still remain below 0° C. as the working medium fluid continues to flow towards the outlet orifice 202B. The temperature and the pressure of the working medium fluid continues to increase as it gets in contact with the energy carrier fluid streaming in via the second inlet port 204B (from the direction of the outlet orifice 202B) within the vane motor 110. The cold liquid CO2 may exit the vane motor 110, i.e. via the outlet orifice 202B at high temperature and high pressure. The energy carrier fluid flow entering the embedded heat exchanger 114 via the first inlet port 204A (in proximity to the inlet orifice 202A) may be controlled, such that the working medium fluid is at ambient room temperature, i.e. about 20° C. or higher when the working medium fluid exits the vane motor 110. The energy carrier fluid may exit at a lower temperature via the first and second outlet ports 206A, 206B positioned midway of the embedded heat exchanger 114, where the resultant temperature of the energy carrier fluid is at around 1° C. (the energy carrier fluid exiting embedded heat exchanger 114 at the lower temperature may be referred to as "chilled energy carrier fluid").

Upon the heat exchange, the temperature of the working medium fluid may increase to a fourth temperature. The fourth temperature may be within a temperature range of 20° C. to 32° C. As such, the working medium fluid may exit the vane motor 110 at the fourth temperature of about 20° C. Upon exiting the vane motor 110, the working medium fluid may be directed to flow into the storage container 102 where the pressure is slightly lower than the initial pressure (i.e. the first pressure) when it just started operation. A second check valve 130B may be positioned between the vane motor 110 and the storage container 102, to prevent a backflow of the working medium fluid. The first and the second check valves 130A, 130B may prevent back flow of the working medium fluid, especially when the apparatus for energy conversion 100 is not in operation. The working medium fluid is recycled continuously and flows through all the intermediary devices via a first piping network 122, until the pressure release valve 104 of the storage container 102 is closed.

The energy carrier fluid may be directed to flow through a second piping network 124. When the chilled energy carrier fluid exits the embedded heat exchanger 114, via the first and second outlet ports 206A, 206B, the chilled energy carrier fluid may be directed to a secondary pump 126. The secondary pump 126 may pump the chilled energy carrier fluid to a chiller heat exchanger 128. The chiller heat exchanger 128 may be configured to receive the energy carrier fluid from the embedded heat exchanger 114, via the secondary pump 126. The chiller heat exchanger 128 may be further configured to raise the temperature of the energy carrier fluid up from the third temperature. The chilled energy carrier fluid gets warmer and may have to harvest more heat before flowing back to the embedded heat exchanger 114, to deliver energy to the vane motor 110 and the electricity generator 118. A third check valve 130C may be positioned between the vane motor 110 and the chiller heat exchanger 128, to prevent a backflow of the energy carrier fluid.

In some embodiments, the flow-regulating valves 120A, 120B may control the flow rate of the energy carrier fluid, such that the energy carrier fluid exits at a temperature just above 0° C. via the first and second outlet ports 206A, 206B. The working medium fluid exits to the storage container 102 at the fourth temperature which may be above 20° C. and above but below 32° C.

It may be noted that an initial filling of the working medium fluid in the storage container 102 from external source may be done via an inlet 132 by opening a corresponding first valve 134 and closing a second valve 136 and closing the pressure release valve 104. It should be noted that second valve 136 may be opened for initial purging of residual air in the apparatus piping and devices. The second valve 136 may be closed after a few seconds to allow filling of the working medium fluid to about 70 bars as indicated by a second pressure gauge 138, before closing the first valve 134. A pressure relief valve 140 is a safety valve provided to prevent over pressure, i.e. beyond a threshold pressure value. For example, the pressure relief valve 140 may prevent the pressure from going above 150 bars (i.e. threshold pressure value), especially when the apparatus for energy conversion 100 is not in operation and is left in a hot environment. When there is an overpressure in the apparatus for energy conversion 100, the pressure can be released by opening the second valve 136, and the working medium fluid can be collected at an outlet 142.

Figure 5:
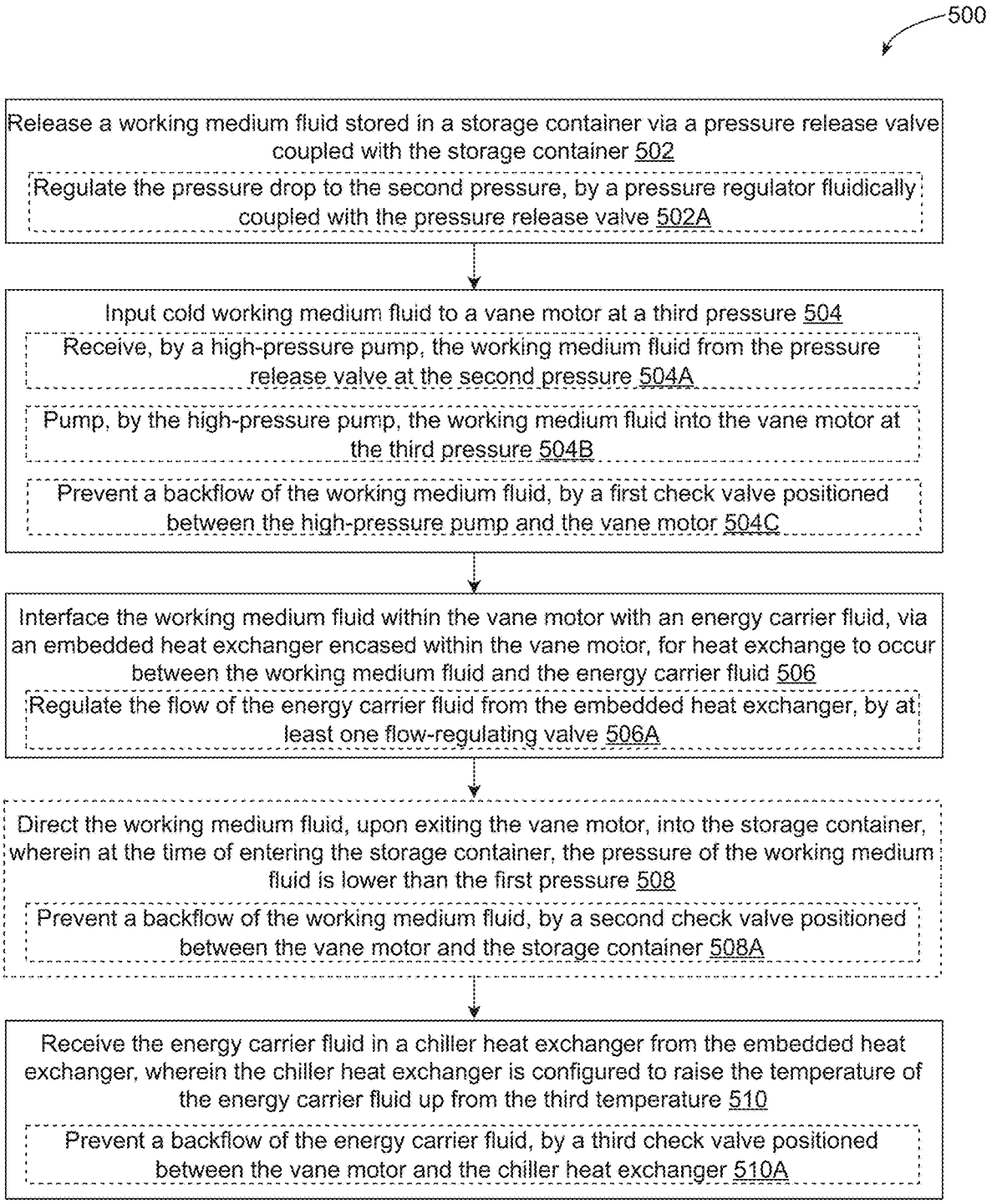
FIG. 5 is flowchart of a method of energy conversion, in accordance with an implementation of the present disclosure.

Referring now to FIG. 5, a flowchart of a method 500 of energy conversion to dual-functionality is illustrated, in accordance with an implementation of the present disclosure. The flowchart of the method 500 is explained in conjunction with FIGS. 1-4.

At step 502, a working medium fluid stored in the storage container 102 may be released via the pressure release valve 104 which may be coupled with the storage container 102. Prior to releasing the working medium fluid stored in the storage container, the method may include filling the working medium fluid in the storage container 102 from an external source via an inlet, by opening the corresponding first valve 134 and closing the second valve 136 and closing the pressure release valve 104. The working medium fluid may be stored in the storage container at the first temperature and the first pressure. The pressure release valve 104 may be configured to release the working medium fluid to the second pressure. As a result of the release, the temperature of the working medium fluid may drop to the second temperature. The second pressure may be less than the first pressure, and the second temperature may be less than the first temperature of the working medium fluid. For example, the second temperature of the working medium fluid may be less than or equal to −40° C. In some embodiments, releasing the working medium fluid stored in the storage container 102 may include step 502A at which the pressure drop to the second pressure may be regulated by the pressure regulator 106. To this end, the pressure regulator 106 may be fluidically coupled with the pressure release valve 104, as shown in FIG. 1.

At step 504, the working medium fluid now cold may be input to the vane motor 110 at the third pressure. The third pressure may be greater than the second pressure. In some embodiments, inputting the cold working medium fluid to the vane motor 110 may include step 504A at which the working medium fluid may be received by the high-pressure pump 112, from the pressure release valve 104 at the second pressure. To this end, the high-pressure pump 112 may be positioned between the pressure release valve 104 and the vane motor 110. In some embodiments, inputting the cold working medium fluid to the vane motor 110 may further include step 504B, at which the working medium fluid may be pumped by the high-pressure pump 112 into the vane motor 110 at the third pressure. Further, in some embodiments, inputting the cold working medium fluid to the vane motor 110 may include step 504C at which a backflow of the working medium fluid may be prevented by the first check valve 130A. To this end, the first check valve 130A may be positioned between the high-pressure pump 112 and the vane motor 110.

At step 506, the cold working medium fluid within the vane motor 110 may be interfaced with the energy carrier fluid, via the embedded heat exchanger 114 encased within the vane motor 110, for heat exchange to occur between the cold working medium fluid and the energy carrier fluid. Upon the heat exchange, the temperature and pressure of the working medium fluid increases and the temperature of the energy carrier fluid decreases. For example, upon the heat exchange, the temperature of the working medium fluid may increase to the fourth temperature within the temperature range of 20° C. to 32° C. Further, upon the heat exchange, the temperature of the energy carrier fluid may decrease to a third temperature which may be close to 1° C., the first conversion function. The embedded heat exchanger 114 may be contained in the (removable) ring module 210, a ring-shaped structure, configured to be removably encased within the vane motor 110. The vane motor 110 may be rotated under combined effect of the working medium fluid entering the vane motor 110 at the third pressure and the pressure of the working medium fluid increasing upon the heat exchange. In some embodiments, interfacing the working medium fluid within the vane motor 110 with the energy carrier fluid may include step 506A, at which the flow of the energy carrier fluid from the embedded heat exchanger 114 may be regulated, by the at least one flow-regulating valve which may be fluidically coupled with the at least one outlet port. In particular, the at least one flow-regulating valve may include flow-regulating valves 120A, 120B fluidically coupled with the first and second outlet ports 206A, 206B, respectively.

The vane motor 110 may be rotated under combined effect of the working medium fluid entering the vane motor 110 at the third pressure and the pressure of the working medium fluid increasing upon the heat exchange. This rotation of the vane motor 110 may cause to drive the electricity generator 118 which may be mechanically coupled within the vane motor 110, to thereby generate electric power. In particularly, the electricity generator 118 may be mechanically coupled with the vane motor 110, via the plurality of vanes 116 of the vane motor 110. The plurality of vanes 116 of the vane motor 110 may be configured to engage with the plurality of slots 304 on the outer side 302 of the electricity generator 118. Hence, the electricity generator 118 within the vane motor 110 acts as the rotor, i.e. the second conversion function.

In some embodiments, at step 508, the working medium fluid, upon exiting the vane motor 110, may be directed into the storage container 102. At the time of entering the storage container 102, the pressure of the working medium fluid may be lower than the first pressure. Further, in some embodiments, directing the working medium fluid into the storage container 102 may include step 508A, at which a backflow of the working medium fluid may be prevented, by the second check valve 1308. To this end, the second check valve 1308 may be positioned between the vane motor 110 and the storage container 102.

At step 510, the energy carrier fluid may be received in the chiller heat exchanger 128 from the embedded heat exchanger 114. The chiller heat exchanger 128 may be configured to raise the temperature of the energy carrier fluid up from the third temperature, upon receiving the energy carrier fluid form the embedded heat exchanger 114. Further, in some embodiments, freshwater may be produced via condensation of water vapour in the atmosphere at the chiller heat exchanger 128. In some embodiments, receiving the energy carrier fluid in the chiller heat exchanger 128 from the embedded heat exchanger 114 may further include step 510A, at which a backflow of the energy carrier fluid may be prevented, by the third check valve 130C. To this end, the third check valve 130C may be positioned between the vane motor 110 and the chiller heat exchanger 128.

It should be noted that when there is an overpressure in the apparatus for energy conversion 100, the method may further include releasing the pressure by opening the second valve 136, and collecting the working medium fluid at the outlet 142.

While specific language has been used to describe the present subject matter, any limitations arising on account thereto, are not intended. As would be apparent to a person in the art, various working modifications may be made to the method in order to implement the inventive concept as taught herein. The drawings and the foregoing description give examples of implementations. Those skilled in the art will appreciate that one or more of the described elements may well be combined into a single functional element. Alternatively, certain elements may be split into multiple functional elements. Elements from one implementation may be added to another implementation.

| Reference Numerals | |
|---|---|
| 100 | apparatus for energy conversion |
| 102 | storage container |
| 104 | pressure release valve |
| 106 | pressure regulator |
| 108 | first pressure gauge |
| 110 | vane motor |
| 112 | high-pressure pump |
| 114 | embedded heat exchanger |
| 116 | plurality of vanes |
| 118 | electricity generator |
| 120A, 120B | flow-regulating valves |
| 122 | first piping network |
| 124 | second piping network |
| 126 | secondary pump |
| 128 | chiller heat exchanger |
| 130A | first check valve |
| 130B | second check valve |
| 130C | third check valve |
| 132 | Inlet |
| 134 | first Valve |
| 136 | second Valve |
| 138 | second pressure gauge |
| 140 | pressure relief valve |
| 142 | outlet |
| 200 | a schematic perspective view |
| 202A | inlet orifice |
| 202B | outlet orifice |
| 204A | first inlet port |
| 2048 | second inlet port |
| 206A | first outlet port |
| 2068 | second outlet port |
| 208 | inner wall |
| 210 | ring module |
| 300 | a schematic front view |
| 302 | outer side |
| 304 | plurality of slots |
| 400 | a schematic front view |
| 500 | flowchart of a method |

-continued

| Reference Numerals | |
|---|---|
| 502 | release a working medium fluid stored in a storage container via a pressure release valve coupled with the storage container |
| 502A | regulate the pressure drop to the second pressure, by a pressure regulator fluidically coupled with the pressure release valve |
| 504 | Input cold working medium fluid to a vane motor at a third pressure |
| 504A | receive, by a high-pressure pump, the working medium fluid from the pressure release valve at the second pressure |
| 504B | pump, by the high-pressure pump, the working medium fluid into the vane motor at the third pressure |
| 504C | prevent a backflow of the working medium fluid, by a first check valve positioned between the high-pressure pump and the vane motor |
| 506 | interface the working medium fluid within the vane motor with an energy carrier fluid, via an embedded heat exchanger encased within the vane motor, for heat exchange to occur between the working medium fluid and the energy carrier fluid |
| 506A | regulate the flow of the energy carrier fluid from the embedded heat exchanger, by at least one flow-regulating valve |
| 508 | direct the working medium fluid, upon exiting the vane motor, into the storage container, wherein at the time of entering the storage container, the pressure of the working medium fluid is lower than the first pressure |
| 508A | prevent a backflow of the working medium fluid, by a second check valve positioned between the vane motor and the storage container |
| 510 | receive the energy carrier fluid in a chiller heat exchanger from the embedded heat exchanger, wherein the chiller heat exchanger is configured to raise the temperature of the energy carrier fluid up from the third temperature |
| 510A | prevent a backflow of the energy carrier fluid, by a third check valve positioned between the vane motor and the chiller heat exchanger |

The invention claimed is:

1. An apparatus for energy conversion, the apparatus comprising:

a storage container configured to store a working medium fluid at a first temperature and a first pressure;

a pressure release valve coupled with the storage container, the pressure release valve configured to release the working medium fluid to a second pressure, wherein temperature of the working medium fluid drops to a second temperature as a result of release of the working medium fluid from the storage container, the second pressure being lower than the first pressure, and the second temperature being lower than the first temperature of the working medium fluid;

a vane motor connected to the pressure release valve and configured to receive the working medium fluid at a third pressure, the third pressure being greater than the second pressure; and an embedded heat exchanger encased within the vane motor, the embedded heat exchanger configured to induce an interface between the working medium fluid within the vane motor and an energy carrier fluid, for heat exchange to occur between the working medium fluid and the energy carrier fluid, wherein upon the heat exchange between the working medium fluid and the energy carrier fluid, the temperature and pressure of the working medium fluid increase whilst the temperature of the energy carrier fluid decreases, wherein the embedded heat exchanger is embedded within a wall of a ring module configured to be removably encased within the vane motor, and wherein the vane motor is configured to rotate under combined effect of the working medium fluid entering the vane motor at the third pressure and the pressure of the working medium fluid increasing upon the heat exchange.

2. The apparatus of claim 1 further comprising:

a pressure regulator fluidically coupled with the pressure release valve, the pressure regulator being configured to regulate the pressure drop to the second pressure.

3. The apparatus of claim 1 further comprising:

a high-pressure pump positioned between the pressure release valve and the vane motor, the high-pressure pump configured to:

receive the working medium fluid from the pressure release valve at the second pressure; and pump the working medium fluid into the vane motor at the third pressure.

4. The apparatus of claim 1 further comprising:

an electricity generator mechanically coupled within the vane motor and configured to generate electric power using the rotation of the vane motor, wherein the electricity generator is mechanically coupled with the vane motor, via a plurality of vanes of the vane motor configured to engage with a plurality of slots on an outer side of the electricity generator.

5. The apparatus of claim 1, wherein the working medium fluid is Carbon Dioxide, and wherein the energy carrier fluid is water.

6. The apparatus of claim 4, wherein the embedded heat exchanger comprises:

a peripheral enclosure along a periphery of the ring module defining:

a closed space, wherein the peripheral enclosure is configured to receive the energy carrier fluid in the closed space; and an inner wall acting as an inner surface of the vane motor, the inner wall creating the interface between the working medium fluid within the vane motor and the energy carrier fluid within the closed space;

an inlet orifice configured to allow passage of the working medium fluid into the vane motor, across the peripheral enclosure;

an outlet orifice configured to allow passage of the working medium fluid out of the vane motor, across the peripheral enclosure;

at least one inlet port configured to allow passage of the energy carrier fluid into the peripheral enclosure; and at least one outlet port configured to allow passage of the energy carrier fluid out of the peripheral enclosure.

7. The apparatus of claim 6, wherein the at least one inlet port comprises:

a first inlet port positioned in proximity to the inlet orifice; and a second inlet port positioned in proximity to the outlet orifice, and wherein the at least one outlet port comprises:

a first outlet port positioned substantially mid-way of the first inlet port and the second inlet port; and a second outlet port positioned substantially mid-way of the first inlet port and the second inlet port.

8. The apparatus of claim 7, wherein at least one of the first inlet port and the second inlet port and at least one of the first outlet port and the second outlet port are placed on a same flank side of the ring module.

9. The apparatus of claim 6, further comprising:

at least one flow-regulating valve fluidically coupled with the at least one outlet port, the at least one flow-regulating valve configured to regulate flow of the energy carrier fluid from the embedded heat exchanger.

10. The apparatus of claim 3 further comprising:

a chiller heat exchanger configured to receive the energy carrier fluid from the embedded heat exchanger, via a secondary pump, the chiller heat exchanger further configured to raise the temperature of the energy carrier fluid up from a third temperature.

11. The apparatus of claim 6, wherein a heat exchange area is defined on a portion of the peripheral enclosure, wherein the heat exchange occurs along the heat exchange area.

12. The apparatus of claim 11, wherein each pair of vanes of the plurality of vanes of the vane motor along with the inner wall defines a vane chamber therebetween, wherein a volume of vane chambers defined along the heat exchange area is the same.

13. The apparatus of claim 1, wherein the second temperature of the working medium fluid is less than or equal to −40° C., wherein, upon the heat exchange, the temperature of the working medium fluid increases to a fourth temperature, wherein the fourth temperature is within a temperature range of 20° C. to 32° C., and wherein, upon the heat exchange, the temperature of the energy carrier fluid decreases to a third temperature, wherein the third temperature is close to 1° C.

14. The apparatus of claim 1, wherein the working medium fluid, upon exiting the vane motor, is directed into the storage container, wherein at the time of entering the storage container, the pressure of the working medium fluid is lower than the first pressure.

15. The apparatus of claim 10 further comprising at least one of:

a first check valve positioned between the high-pressure pump and the vane motor, to prevent a backflow of the working medium fluid;

a second check valve positioned between the vane motor and the storage container, to prevent a backflow of the working medium fluid; and a third check valve positioned between the vane motor and the chiller heat exchanger, to prevent a backflow of the energy carrier fluid.

16. The apparatus of claim 1, wherein the first temperature and the first pressure are predefined.

17. The apparatus of claim 1 further comprising:

a pressure relief valve configured to release pressure in the apparatus, beyond a threshold pressure value.

18. An embedded heat exchanger comprising:

a ring module configured to be removably encased within a vane motor, wherein the vane motor is configured to receive a working medium fluid at an introductory pressure; and a peripheral enclosure along a periphery of the ring module, the peripheral enclosure defining:

a closed space, wherein the peripheral enclosure is configured to receive an energy carrier fluid in the closed space; and an inner wall creating an interface between a working medium fluid within the vane motor and the energy carrier fluid within the closed space, for heat exchange to occur between the working medium fluid and the energy carrier fluid, wherein upon heat exchange between the working medium fluid and the energy carrier fluid, temperature and pressure of the working medium fluid are to increase whilst the temperature of the energy carrier fluid is to decrease, wherein the vane motor is rotated under combined effect of the working medium fluid entering the vane motor at the introductory pressure and the pressure of the working medium fluid increasing upon the heat exchange, and wherein the embedded heat exchanger is embedded within a wall of the ring module.

19. The embedded heat exchanger of claim 18 further comprising:

an inlet orifice configured to allow passage of the working medium fluid into the vane motor, across the peripheral enclosure;

an outlet orifice configured to allow passage of the working medium fluid out of the vane motor, across the peripheral enclosure;

at least one inlet port configured to allow passage of the energy carrier fluid into the peripheral enclosure; and at least one outlet port configured to allow passage of the energy carrier fluid out of the peripheral enclosure.

20. The embedded heat exchanger of claim 19, wherein the at least one inlet port comprises:

a first inlet port positioned in proximity to the inlet orifice; and a second inlet port positioned in proximity to the outlet orifice, wherein the at least one outlet port comprises:

a first outlet port positioned substantially mid-way of the first inlet port and the second inlet port; and a second outlet port positioned substantially mid-way of the first inlet port and the second inlet port, and wherein at least one of the first inlet port and the second inlet port and at least one of the first outlet port and the second outlet port are placed on a same flank side of the ring module.

21. A method of energy conversion, the method comprising:

releasing a working medium fluid stored in a storage container via a pressure release valve coupled with the storage container, wherein the working medium fluid is stored in the storage container at a first temperature and a first pressure, wherein, as a result of release, the temperature of the working medium fluid drops to a second temperature and the working medium fluid is released at a second pressure, the second pressure being less than the first pressure, and the second temperature being less than the first temperature;

inputting the working medium fluid to a vane motor at a third pressure, the third pressure being greater than the second pressure;

interfacing the working medium fluid within the vane motor with an energy carrier fluid, via an embedded heat exchanger embedded within a ring module encased within the vane motor, for heat exchange to occur between the working medium fluid and the energy carrier fluid, wherein upon the heat exchange, the temperature and pressure of the working medium fluid increases and the temperature of the energy carrier fluid decreases, wherein the vane motor is rotated under combined effect of the working medium fluid entering the vane motor at the third pressure and the pressure of the working medium fluid increasing upon the heat exchange, to drive an electricity generator mechanically coupled within the vane motor to generate electric power; and receiving the energy carrier fluid in a chiller heat exchanger from the embedded heat exchanger, wherein the chiller heat exchanger is configured to raise the temperature of the energy carrier fluid up from the third temperature.

22. The method of claim 21, wherein releasing the working medium fluid comprises:

regulating the pressure drop to the second pressure, by a pressure regulator fluidically coupled with the pressure release valve.

23. The method of claim 21, wherein inputting the working medium fluid to the vane motor comprises:

receiving, by a high-pressure pump, the working medium fluid from the pressure release valve at the second pressure; and pumping, by the high-pressure pump, the working medium fluid into the vane motor at the third pressure, wherein the high-pressure pump is positioned between the pressure release valve and the vane motor.

24. The method of claim 21 further comprising:

generating electric power, by an electricity generator, using the rotation of the vane motor, wherein the electricity generator is mechanically coupled within the vane motor, via a plurality of vanes of the vane motor configured to engage with a plurality of slots on an outer side of the electricity generator.

25. The method of claim 21, wherein the working medium fluid is Carbon Dioxide, and wherein the energy carrier fluid is water.

26. The method of claim 21, wherein the embedded heat exchanger comprises:

a peripheral enclosure along a periphery of the ring module defining:

a closed space, wherein the peripheral enclosure is configured to receive the energy carrier fluid in the closed space; and an inner wall acting as an inner surface of the vane motor, the inner wall creating the interface between the working medium fluid within the vane motor and the energy carrier fluid within the closed space;

an inlet orifice configured to allow passage of the working medium fluid into the vane motor, across the peripheral enclosure;

an outlet orifice configured to allow passage of the working medium fluid out of the vane motor, across the peripheral enclosure;

at least one inlet port configured to allow passage of the energy carrier fluid into the peripheral enclosure; and at least one outlet port configured to allow passage of the energy carrier fluid out of the peripheral enclosure.

27. The method of claim 26, wherein the at least one inlet port comprises:

a first inlet port positioned in proximity to the inlet orifice; and a second inlet port positioned in proximity to the outlet orifice, and wherein the at least one outlet port comprises:

a first outlet port positioned substantially mid-way of the first inlet port and the second inlet port; and a second outlet port positioned substantially mid-way of the first inlet port and the second inlet port.

28. The method of claim 27, wherein at least one of the first inlet port and the second inlet port and at least one of the first outlet port and the second outlet port are placed on a same flank side of the ring module.

29. The method of claim 21, wherein receiving the energy carrier fluid in the chiller heat exchanger comprises:

regulating flow of the energy carrier fluid from the embedded heat exchanger, by at least one flow-regulating valve fluidically coupled with the at least one outlet port.

30. The method of claim 26, wherein a heat exchange area is defined on a portion of the peripheral enclosure, wherein the heat exchange occurs along the heat exchange area.

31. The method of claim 24, wherein each pair of vanes of the plurality of vanes of the vane motor along with the inner wall defines a vane chamber therebetween, wherein a volume of vane chambers defined along the heat exchange area is the same.

32. The method of claim 21, wherein the second temperature of the working medium fluid is less than or equal to −40° C., wherein, upon the heat exchange, temperature of the working medium fluid increases to a fourth temperature, wherein the fourth temperature is within a temperature range of 20° C. to 32° C., and wherein, upon the heat exchange, the temperature of the energy carrier fluid decreases to a third temperature, wherein the third temperature is close to 1° C.

33. The method of claim 21, further comprising:

directing the working medium fluid, upon exiting the vane motor, into the storage container, wherein at the time of entering the storage container, the pressure of the working medium fluid is lower than the first pressure.

34. The method of claim 23 further comprising:

preventing a backflow of the working medium fluid, by a first check valve positioned between the high-pressure pump and the vane motor.

35. The method of claim 21 further comprising:

preventing a backflow of the working medium fluid, by a second check valve positioned between the vane motor and the storage container.

36. The method of claim 21 further comprising:

preventing a backflow of the energy carrier fluid, by a third check valve positioned between the vane motor and the chiller heat exchanger.

37. The method of claim 21, wherein the first temperature and the first pressure are predefined.

38. The method of claim 21 further comprising:

releasing pressure, beyond a threshold pressure value, by a pressure relief valve.

39. The method of claim 21 further comprising:

prior to releasing the working medium fluid stored in the storage container, filling the working medium fluid in the storage container from an external source via an inlet, by opening a corresponding first valve and closing a second valve and closing the pressure release valve.

40. The method of claim 39 further comprising:

releasing the pressure by opening the second valve, when there is an overpressure; and collecting the working medium fluid at an outlet.

* * * * *